US007681690B2

(12) United States Patent
Roberts et al.

(10) Patent No.: US 7,681,690 B2
(45) Date of Patent: Mar. 23, 2010

(54) NOISE ABATEMENT DEVICE FOR A PNEUMATIC TOOL

(75) Inventors: Neil James Roberts, Johannesburg (ZA); William Murray, Malanshof (ZA)

(73) Assignee: Longyear TM, Inc., South Jordan, UT (US)

( * ) Notice: Subject to any disclaimer, the term of this patent is extended or adjusted under 35 U.S.C. 154(b) by 17 days.

(21) Appl. No.: 12/169,514

(22) Filed: Jul. 8, 2008

(65) Prior Publication Data

US 2009/0090530 A1 Apr. 9, 2009

Related U.S. Application Data

(60) Provisional application No. 60/949,566, filed on Jul. 13, 2007.

(51) Int. Cl.
*F01N 1/08* (2006.01)
*F01N 1/02* (2006.01)

(52) U.S. Cl. ..... 181/230; 181/239; 181/274

(58) Field of Classification Search ..... 181/230, 181/238, 239, 249, 255, 274, 279, 231; 173/DIG. 2
See application file for complete search history.

(56) References Cited

U.S. PATENT DOCUMENTS

| | | | | |
|---|---|---|---|---|
| 172,245 | A | 1/1876 | Butler | |
| 706,844 | A * | 8/1902 | Motsinger | 181/239 |
| 888,489 | A * | 5/1908 | Gustafson | 181/239 |
| 969,101 | A | 8/1910 | Gibson | |
| 1,338,520 | A * | 4/1920 | Moores | 181/253 |
| 1,373,221 | A * | 3/1921 | Blackburn | 181/239 |
| 1,468,398 | A * | 9/1923 | Reed | 181/212 |
| 1,644,794 | A | 10/1927 | Saharoff | |
| 1,760,682 | A | 5/1930 | Boysen | |
| 1,838,834 | A | 12/1931 | Holzer | |
| 2,037,102 | A | 4/1936 | Vipond | |
| 2,054,956 | A | 9/1936 | St. Stephens | |
| 2,057,304 | A | 10/1936 | Saint-Jacques | |
| 2,128,742 | A | 8/1938 | Fuehrer | |
| 2,139,736 | A | 12/1938 | Durham | |
| 2,170,704 | A | 8/1939 | Bourne | |
| 2,274,460 | A | 2/1942 | Rauen | |

(Continued)

FOREIGN PATENT DOCUMENTS

DE 3125083 A1 * 1/1983

(Continued)

OTHER PUBLICATIONS

U.S. Appl. No. 12/128,166, filed May 28, 2008, Roberts.

(Continued)

*Primary Examiner*—Edgardo San Martin
(74) *Attorney, Agent, or Firm*—Workman Nydegger

(57) ABSTRACT

Noise-abatement devices are provided for a pneumatic tool that can include a housing having a first end and a second end. An expansion chamber is defined within the expansion chamber. At least one tube is located at least partially within the expansion chamber in which the tube has at least a perforated portion, and an outlet defined therein. The device also includes a port outlet in fluid communication with the expansion chamber in which the port outlet and the outlet are located near the second end of the housing.

29 Claims, 3 Drawing Sheets

U.S. PATENT DOCUMENTS

| | | | | | |
|---|---|---|---|---|---|
| 2,512,823 | A | * | 6/1950 | Blundell | 181/255 |
| 2,562,101 | A | | 7/1951 | Hoyle | |
| 2,660,257 | A | * | 11/1953 | Bourne et al. | 181/238 |
| 2,764,250 | A | | 9/1956 | Jeffords | |
| 2,936,844 | A | | 5/1960 | Gill | |
| 3,066,755 | A | | 12/1962 | Diehl | |
| 3,166,152 | A | * | 1/1965 | Conlin | 181/274 |
| 3,176,791 | A | | 4/1965 | Betts | |
| 3,243,011 | A | | 3/1966 | Hill | |
| 3,255,844 | A | | 6/1966 | Wallace | |
| 3,311,120 | A | | 3/1967 | Palmisano | |
| 3,323,614 | A | | 6/1967 | Thrasher | |
| 3,340,958 | A | | 9/1967 | Conlin | |
| 3,365,022 | A | | 1/1968 | Barber et al. | |
| 3,530,953 | A | | 9/1970 | Conlin | |
| 3,554,316 | A | | 1/1971 | Judd | |
| 3,577,728 | A | * | 5/1971 | Von Brimer et al. | 60/283 |
| 3,599,756 | A | | 8/1971 | Pickle | |
| 3,635,299 | A | | 1/1972 | Hayes | |
| 3,688,868 | A | | 9/1972 | Gibel | |
| 3,750,841 | A | | 8/1973 | Brown | |
| 3,776,366 | A | * | 12/1973 | Betts et al. | 181/239 |
| 3,815,705 | A | | 6/1974 | Bennett | |
| 3,898,064 | A | * | 8/1975 | Tao et al. | 96/386 |
| 3,907,528 | A | * | 9/1975 | Halter | 96/385 |
| 3,927,525 | A | * | 12/1975 | Jacobs | 60/301 |
| 3,927,731 | A | | 12/1975 | Lancaster | |
| 3,941,206 | A | * | 3/1976 | Halter | 181/256 |
| 3,957,446 | A | * | 5/1976 | Mayer et al. | 422/168 |
| 3,981,378 | A | | 9/1976 | Potter | |
| 3,995,712 | A | | 12/1976 | Leistritz | |
| 4,010,819 | A | | 3/1977 | Ekstrom et al. | |
| 4,027,740 | A | | 6/1977 | Martin | |
| 4,028,076 | A | | 6/1977 | Fields | |
| 4,079,809 | A | | 3/1978 | Visnapuu et al. | |
| 4,082,160 | A | | 4/1978 | Schilling et al. | |
| 4,109,749 | A | | 8/1978 | Sweet | |
| 4,113,052 | A | | 9/1978 | McElroy | |
| 4,135,602 | A | | 1/1979 | Clark | |
| 4,244,442 | A | | 1/1981 | Scarton | |
| 4,294,330 | A | | 10/1981 | Baldwin et al. | |
| 4,303,133 | A | | 12/1981 | Godolphin | |
| 4,327,817 | A | | 5/1982 | Scarton | |
| 4,346,783 | A | | 8/1982 | Scarton | |
| 4,402,383 | A | | 9/1983 | Bailey | |
| 4,424,882 | A | * | 1/1984 | Moller | 181/231 |
| 4,474,260 | A | * | 10/1984 | Valentine | 181/230 |
| 4,496,023 | A | | 1/1985 | Lindberg et al. | |
| 4,558,763 | A | | 12/1985 | Montabert | |
| 4,565,259 | A | * | 1/1986 | Stoll | 181/230 |
| 4,624,339 | A | | 11/1986 | Marcel et al. | |
| 4,880,078 | A | | 11/1989 | Inoue et al. | |
| 5,152,366 | A | | 10/1992 | Reitz | |
| 5,214,253 | A | * | 5/1993 | Houston, Jr. | 181/238 |
| 5,214,254 | A | * | 5/1993 | Sheehan | 181/241 |
| 5,373,119 | A | * | 12/1994 | Suzuki et al. | 181/230 |
| 5,376,762 | A | | 12/1994 | Kimberlin | |
| 5,545,860 | A | | 8/1996 | Wilkes et al. | |
| 5,581,055 | A | | 12/1996 | Self et al. | |
| 5,729,973 | A | | 3/1998 | Zander et al. | |
| 5,731,556 | A | | 3/1998 | Gardner et al. | |
| 5,844,178 | A | * | 12/1998 | Lothringen | 181/269 |
| 5,952,623 | A | | 9/1999 | Sterling | |
| 6,199,656 | B1 | | 3/2001 | Vento et al. | |
| 6,382,348 | B1 | | 5/2002 | Chen | |
| 6,457,551 | B1 | * | 10/2002 | Chang | 181/243 |
| 6,576,028 | B2 | | 6/2003 | Santos | |
| 6,668,971 | B2 | | 12/2003 | Sterling | |
| 6,679,351 | B2 | * | 1/2004 | Cummings et al. | 181/212 |
| 6,892,853 | B2 | * | 5/2005 | Cai et al. | 181/249 |
| 6,959,782 | B2 | | 11/2005 | Brower et al. | |
| 7,040,451 | B2 | | 5/2006 | Schumacher et al. | |
| 7,052,247 | B2 | * | 5/2006 | Lee | 417/312 |
| 7,191,868 | B2 | * | 3/2007 | Craig et al. | 181/231 |
| 7,216,739 | B2 | | 5/2007 | Sterling | |
| 2006/0037811 | A1 | * | 2/2006 | Kensok et al. | 181/249 |

FOREIGN PATENT DOCUMENTS

| | | |
|---|---|---|
| JP | S53-28503 | 3/1978 |
| JP | S57-148013 | 9/1982 |
| JP | S59-126118 | 8/1984 |
| JP | S60-98711 | 7/1985 |
| JP | 07-248090 | 9/1995 |
| JP | 2006-194157 | 7/2006 |
| WO | WO 03009974 | 2/2003 |

OTHER PUBLICATIONS

International Search Report mailed Jun. 23, 2009 from PCT Application No. PCT/US08/087637 (3 pages).
International Search Report mailed Jan. 5, 2009 from PCT Application No. PCT/US08/069992 (3 pages).
Office Action dated Jun. 24, 2009 from U.S. Appl. No. 12/128,166 (9 pages).

* cited by examiner

NOISE ABATEMENT DEVICE FOR A PNEUMATIC TOOL

RELATED APPLICATIONS

This application claims the benefit of U.S. Patent Application Ser. No. 60/949,566 filed Jul. 13, 2007, which is hereby incorporated by reference in its entirety.

BACKGROUND OF THE INVENTION

1. The Field of the Invention

This application relates generally to noise-abatement devices. In particular, this application discusses noise-abatement devices for use with pneumatically operated tools, such as pneumatic percussive drills.

2. The Relevant Technology

The process of converting energy stored in compressed air into motion for powering a pneumatic tool generates a significant amount of noise as the spent air (exhaust) is exhausted. In particular, pneumatic tools are often operated by compressed air that is directed to a pneumatic cylinder. As compressed air expands in the cylinder, the air exerts pressure on an internal piston causing the piston to move from an initial position in a first direction for a determined distance. The travel of the piston within the pneumatic cylinder can be referred to as a stroke. As the piston nears the end of the stroke, the air in the cylinder is exhausted by way of an exhaust port. The piston is then returned to its initial position by an opposing force that is often provided by a spring and/or compressed air applied to the opposite side of the piston and the process begins again.

As spent compressed air is exhausted from the pneumatic cylinder, the spent compressed air expands rapidly causing a loud noise. Often, the operation of pneumatic tools requires a close proximity between the tool and an operator, and the noise generated by the tool can be loud enough to be potentially harmful to the operator. There are many approaches to reduce the noise from these devices. A common approach is a muffler consisting of an expansion chamber into which the exhaust flows and expands before venting to the atmosphere. Such designs take various geometric shapes including cylindrical, kidney-shaped, and rectangular. Another approach includes incorporating a series of internal chambers within an expansion chamber to allow the exhaust to progressively expand. While such approaches offer some improvement in noise reduction, given the close proximity of pneumatic tools and their operators, the noise reduction of current approaches is often insufficient to acceptably reduce the damaging and/or painful noise levels.

The subject matter claimed herein is not limited to embodiments that solve any disadvantages or that operate only in environments such as those described above. Rather, this background is only provided to illustrate one exemplary technology area where some examples described herein can be practiced

BRIEF SUMMARY OF THE INVENTION

Noise-abatement devices are provided for a pneumatic tool that can include a housing having a first end and a second end. An expansion chamber is defined within the expansion chamber. At least one tube is located at least partially within the expansion chamber in which the tube has at least a perforated portion, and an outlet defined therein. The device also includes a port outlet in fluid communication with the expansion chamber in which the port outlet and the outlet are located near the second end of the housing.

A noise-abatement device for a pneumatic tool can also include a housing having a first end and a second end in which the housing defines an expansion chamber. At least one tube is located at least partially within the expansion chamber, the tube having at least a perforated portion, a non-perforated portion, and an outlet defined therein. A port outlet is in fluid communication with the expansion chamber in which the port outlet is located adjacent at least part of the non-perforated portion.

A pneumatic tool can include a cylinder body having a tool outlet defined therein as well as a noise-abatement device fluidly coupled to the tool outlet. The noise-abatement device has a housing having a first end a second end, the housing defining an expansion chamber therein. At least one tube is located at least partially within the expansion chamber, the tube having a perforated portion, a non-perforated portion, and an outlet defined therein. Exhaust from the tool outlet enters the expansion chamber near the non-perforated portion of the tube.

A pneumatic percussive drill can also include a body having a port outlet defined therein, a housing defining an expansion chamber, the housing being secured to the body, and a plurality of tubes located at least partially within the expansion chamber. The tubes each have a perforated portion, a non-perforated portion, and an outlet in which the non-perforated portions are positioned adjacent the port outlet and wherein at least one of the outlets vents to atmosphere through the housing.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

BRIEF DESCRIPTION OF THE DRAWINGS

To further clarify the above and other advantages and features of the present invention, a more particular description of the invention will be rendered by reference to examples which are illustrated in the appended drawings. It is appreciated that these drawings depict only examples and are therefore not to be considered limiting of its scope. The following description can be better understood in light of the Figures, in which.

Figure 1:
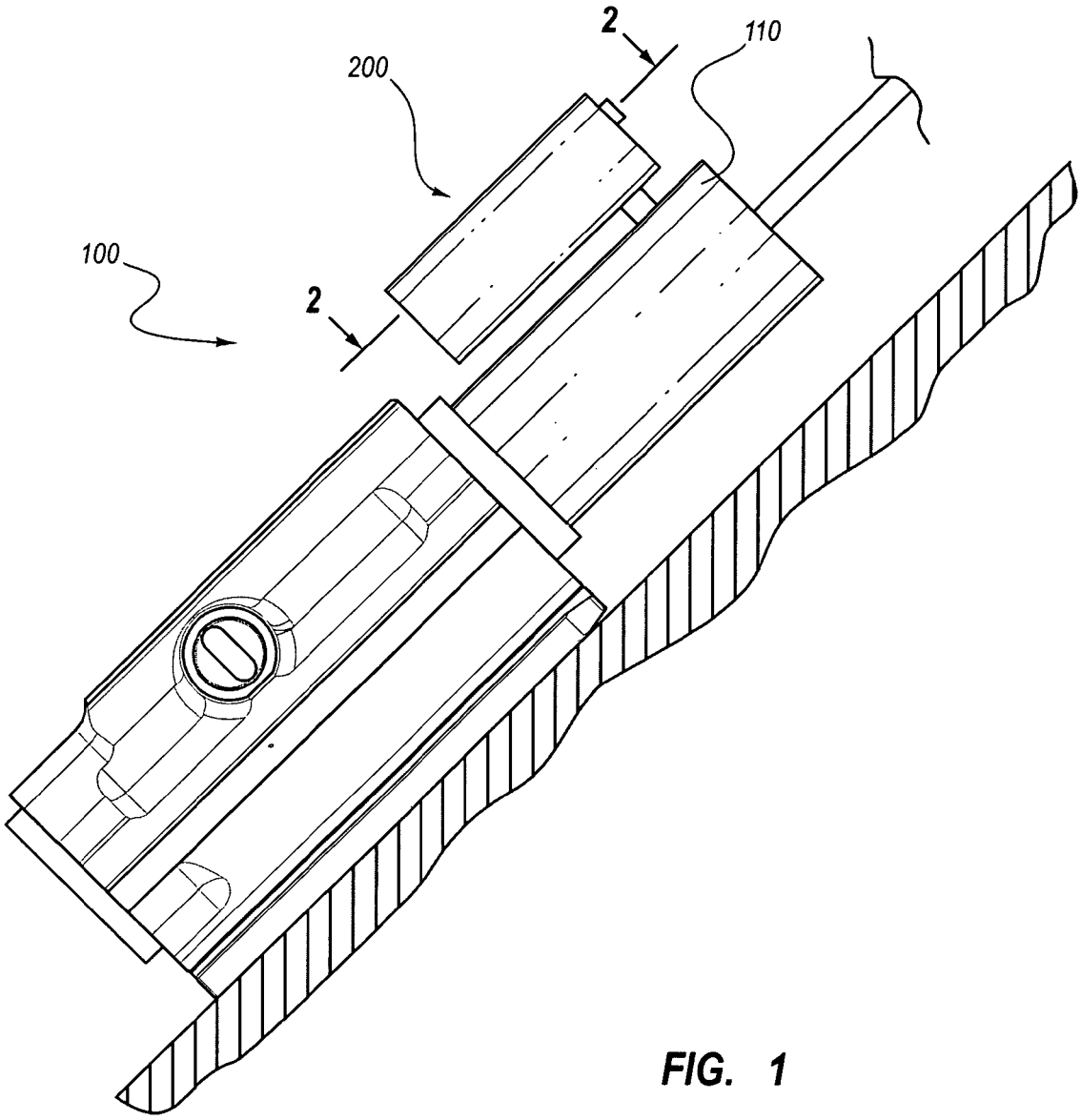
FIG. 1 illustrates a pneumatic tool having a noise-abatement device according to one example.

Together with the following description, the Figures demonstrate the features of the noise-abatement devices and methods for making and using the noise-abatement device. The thickness and configuration of components can be exaggerated in the Figures for clarity. The same reference numerals in different drawings represent the same element.

DETAILED DESCRIPTION OF THE PREFERRED EMBODIMENTS

A noise-abatement device is provided herein for reducing noise associated with exhausting air during the operation of pneumatic tools. In at least one example, the noise-abatement device includes a housing defining an expansion chamber and a port outlet in the housing that provides fluid communication with the expansion chamber and a pneumatic device. The expansion chamber includes a first end and a second end. An outlet is associated with the second end of the expansion chamber. The outlet vents the exhaust from the noise-abatement device. The noise-abatement device also includes at least one tube located within the expansion chamber. The tube includes a perforated portion and a non-perforated portion. The tube, and at least part of the non-perforated portion in particular, can be part of or be in communication with the outlet. The term exhaust shall be broadly understood to mean exhausted fluid, such as a partially expanded compressed air, that passes through the noise-abatement device.

Exhaust directed from the expansion chamber enters the housing at the port outlet. In at least one example, the port outlet can be near a second end of the expansion chamber. As the exhaust enters the expansion chamber, the exhaust expands. As the exhaust expands, the exhaust moves from the port outlet through the expansion chamber and into the tube by way of the holes defined in the perforated portion. In at least one example, the non-perforated portion of the tube is positioned near the second end of the expansion chamber and thus in proximity with the port outlet. Further, in at least one example the perforated portion of the tube can begin where the non-perforated portion ends and can extend toward the first end of the expansion chamber. Such a configuration can cause the exhaust to move from the second end of the expansion chamber toward the first end as the exhaust enters the tube. Once the exhaust enters the perforated portion of the tube, the exhaust can then naturally move toward lower pressure areas. In at least one example, the non-perforated portion of the tube can be part of or in fluid communication with an outlet such that exhaust entering the perforated portion of the tube moves toward the outlet. Such a configuration can increase the distance, and thus time, over which the exhaust expands. Increasing the time over which the exhaust expands in turn can reduce the noise associated with venting the exhaust to atmosphere.

In at least one example, the noise-abatement device is part of a pneumatic drilling system. It will be appreciated that the noise-abatement device and associated systems and methods can be implemented and used without employing these specific details. Indeed, the device and associated tools can be placed into practice by modifying the device and associated systems and methods and can be used in conjunction with any existing apparatus, system, component, and/or technique. For example, while the description below focuses on a noise-abatement device used with pneumatically operated percussive drills, the device can be modified for any pneumatically-operated tools with a sudden exhaust, such as a blower, a breaker, an impact wrench, or any other type of device. The noise-abatement device can also be used with any rapid gas exhaust device, including any suitable safety valve, compressor exhaust, or expanding gas vent.

FIG. 1 illustrates a pneumatic tool 100. The pneumatic tool 100 includes a noise-abatement device 200 in fluid communication with a body 110 of the pneumatic tool. In the illustrated example, the pneumatic tool 100 is a pneumatic percussive drill. It will be appreciated that the noise-abatement device 200 can be used with any pneumatic tool, including the pneumatic tools described above. The noise-abatement device 200 reduces the noise associated with expansion of exhausted compressed air as the pneumatic tool 100 operates. The noise-abatement device 200 is illustrated in more detail with reference to FIG. 2.

Figure 2:
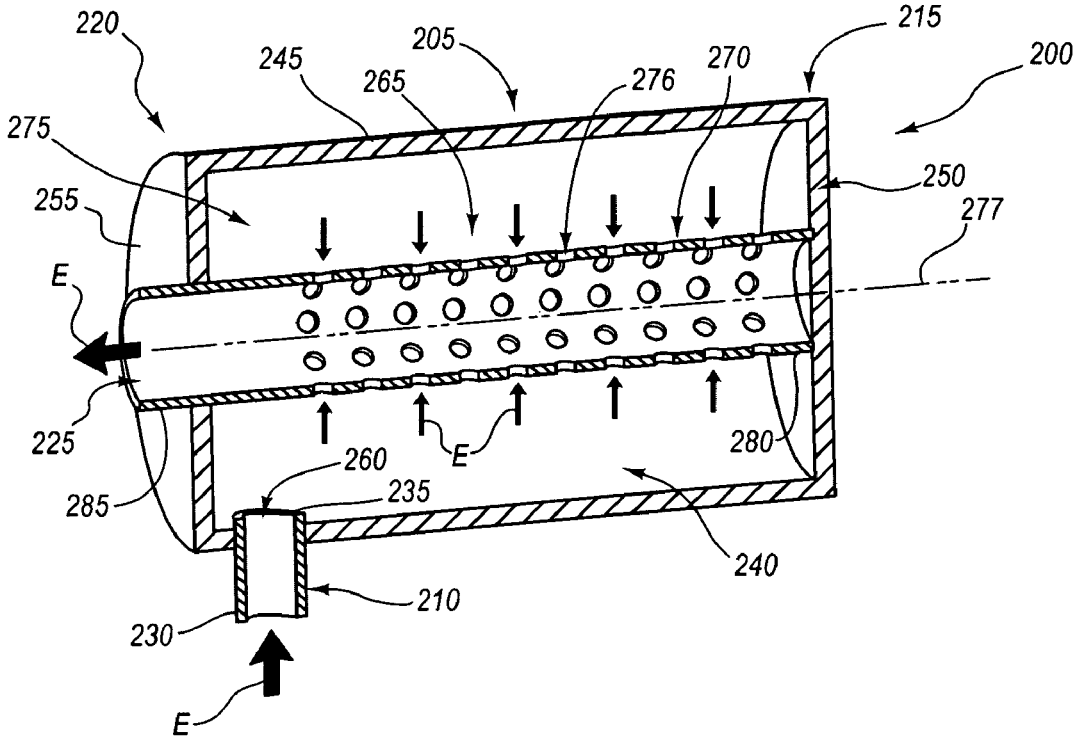
FIG. 2 illustrates a partial cross-sectional view of a noise-abatement device according to one example.

FIG. 2 illustrates a partial cross-sectional view of the noise-abatement device 200 taken along section 2-2 in FIG. 1. As shown in FIG. 2, the noise-abatement device 200 can include a housing 205 and a tool port 210. The housing 205 in turn can include a first end 215 and a second end 220. An outlet 225 is in fluid communication with the second end 220 of the housing 205. At least a portion of the outlet 225 can be located proximate to a longitudinal axis (277, FIG. 2). In the illustrated example, the outlet 225 includes one or more openings in communication with the second end 220. Exhaust from a pneumatic tool is introduced to the noise-abatement device 200 by way of the tool port 210, passes through the noise abatement device 200 and is vented through the outlet 225. The structure and formation of the exemplary noise-abatement device 200 will first be discussed followed by a discussion of the flow of an exhaust stream through the noise-abatement device 200.

It will be appreciated that the outlet 225 can include openings that are distributed about some portion of the length of the housing 205 or other configurations that allow the noise-abatement device 200 to exhaust air introduced into the housing 205 from the tool port 210. Further, the outlet 225 can be any shape, including circular, ellipsoidal, square, rectangular, polygonal, and combinations of these shapes. Indeed, FIG. 2 shows that the outlet 225 can be substantially circular in some examples.

The tool port 210 is configured to fluidly couple the housing 205 to a pneumatic tool, such as to a pneumatically-operated percussive drill. For example, the tool port 210 can include a first end 230 and a second end 235. The first end 230 is configured to be fluidly coupled to a pneumatic tool or can be directly coupled to the pneumatic tool. The second end 235 is in fluid communication with the first end 230, which is in fluid communication with the housing 205. The first end 230 of the tool port 210 can be adapted so that it can be coupled to any desired pneumatic tool as known in the art, including by welding, bonding, or fastening. Moreover, in some instances, the noise-abatement device can be configured to be selectively coupled to and uncoupled from a pneumatic tool, as desired.

In at least one example, such as the example illustrated in FIG. 2, the tool port 210 can extend beyond the intersection of the main body 205 and the tool port 210. The second end 235 of the tool port 210 can be coupled to the housing 205 through any method, including, but not limited to, welding, bonding, or fastening. In at least one example, the tool port 210 can be in airtight fluid communication with the housing 205.

As further illustrated in FIG. 2, the housing 205 can define an open-space therein to thereby form an expansion chamber 240. In particular, the housing 205 can include a main body 245 at least partially between the first end 215 and the second end 220 that defines a perimeter of the expansion chamber 240. Further, the first end 215 in the illustrated example terminates in a first end wall 250 while the second end 220 can terminate in a second end wall 255.

The expansion chamber 240 can be any size suitable for use with a pneumatic tool. For example, the chamber can be as long as about 3m or as short as about 5 mm. Nevertheless, it will be appreciated that the length of the expansion chamber 200 can be longer or shorter as desired.

The expansion chamber 240 can have any height, width, and/or diameter suitable for reducing the noise from a pneumatic tool. For example, where the chamber 240 has a substantially circular cross section, the diameter of the chamber can range from about 5 mm to about 1 m. In another example, however, the chamber can have a diameter between about 40 mm and about 60 mm. However, it will be appreciated that the expansion chamber 240 can be sized as desired for using with any number pneumatic tools.

A port outlet 260 is formed in the main body 245 to provide fluid communication between the tool port 210 and the expansion chamber 240. In the illustrated example, the tool port 210 is positioned transversely to a longitudinal axis 277 of the expansion chamber 240. Further, the port outlet 260 is positioned near the second end 220 of the housing 205. As illustrated in FIG. 2, the noise-abatement device 200 also includes at least one tube 265 located at least partially within the expansion chamber 240. The tool port 210 can be oriented and positioned at any desired location and/or orientation.

The tube 265 can have any characteristic that allows the noise-abatement device 200 to reduce noise produced by a pneumatic tool. In the illustrated example, the tube 265 includes a perforated section 270 having holes or perforations 276 defined therein. The perforated section 270 can include any suitable number of holes 276, depending on the desired pressure drop, exhaust flow, and/or noise level. The holes 276 can have any shape, including shapes that can be drilled, machined, laser-cut, eroded or otherwise formed. These shapes can further include circular, square, polygonal, irregular shapes, other shapes, and/or any combination of shapes. Further, the perforated tube 265 can be any size (e.g., length, width, height, diameter, etc.) suitable for use with the noise-abatement device 200. The size of the holes 276 can range from about 0.05 microns to about 100 mm. The size and shape of the holes can also vary from one hole to the next as desired.

As previously introduced, the port outlet 260 is located near the second end 220 of the housing 205. In particular, the port outlet 260 can be positioned such that the port outlet is in fluid communication with and/or adjacent to the non-perforated portion 275 of the tube 265. In at least one example, at least part of the non-perforated portion 275 is positioned transversely to the port outlet 260 relative to the longitudinal axis 277. As a result, the non-perforated portion 275 may extend from the second end 220 toward the first end 215 to at least a point that is transverse to the distant edge of the port outlet 260. The length of the non-perforated portion 275 can have any length. In some examples, the length of the non-perforated portion can range from about 5 mm or less to about 3 m or more. In some instances, the length of the non-perforated section can range from about 1% to about 90% of the length of the expansion chamber 240.

The perforated portion 270 can comprise any part of the remaining remainder of the tube 265 as desired. At least part of the perforated portion 270 is located opposite the non-perforated portion 275 within the expansion chamber 240 such that at least part of the perforated portion 270 is located relatively closer to the first end 215 of the housing 205. The length of the perforated portion 270 can also depend on the length of the noise-abatement device 200. Accordingly, the length of the perforated portion 270 can range from 5 mm to about 3 m. In some instances, the length of the perforated section can range from about 10% to about 99% of the length of the expansion chamber 240.

The tube 265 can be given any shape or size consistent with its function described herein. Accordingly, the shape of the tube 265 can be square, rectangular, triangular, or substantially circular in cross-section. And when the perforated tube has a substantially circular cross-section, the diameter can range from about 5 mm to about 1 m. The perforated tube can also vary in shape, section and gauge along its length. Further, while the perforated portion 270 and the non-perforated portion 275 are illustrated as being two separate, continuous portions of the tube 265, it will be appreciated that perforated portions and non-perforated portions may be mixed and interspersed as desired.

The example illustrates shows that the perforated tube 265 can be disposed near the longitudinal axis 277 of the expansion chamber 240. In particular, the tube 265 can include a first end 280 and a second end 285. The first end 280 of the tube 265 can be joined to the first end 215 of the housing 205. For example, the first end 280 can be secured to the first end wall 250 in any suitable manner.

In at least one example, the second end 285 can be sealingly joined to the second end wall 255 and extend through the second end wall 255. In such examples, the outlet 225 can be located beyond the second end wall 255. While the tube 265 is illustrated as being secured to the first end wall 250 and extending through the second end wall 255, it will be appreciated that the first end 280 of the tube 265 can also end short of the first end wall 250 or can extend away first end wall 250 and end at or short of the second end wall 255.

The first and second end walls 250, 255 can have any characteristic that helps the noise-abatement device 200 to reduce noise from a pneumatic tool. The first and second end walls 250, 255 can have any shape, including, but not limited to, a substantially planar shape, a convex shape, a concave shape, a conical shape, other shapes, or any combination of shapes. For example, FIG. 2 shows the noise-abatement device 200 can include first and second end walls 250, 255 that are substantially planar. Further in the illustrated example, the outlet 225 includes the single opening in the second end 285 of the tube 265. In other examples, any number of openings of any size or combination of sizes can be defined in the second end wall, 255, the first end wall 250 and/or the main body 245. Further, any number of tubes 265 can be located at least partially within the expansion chamber 240 and extend to and/or through the second wall 255.

The resulting expansion chamber 240 formed in the illustrated example has a generally cylindrical shape. It will be appreciated that the expansion chamber 240 can have any shape that can help control the dissipation of the exhaust. Such shapes can include, without limitation, kidney-shaped, rectangular, square, round, conical, ellipsoidal, tubular, conical, polygonal, other shapes or any combination of shapes.

The noise-abatement device 200 can be constructed of any material suitable for a noise-abatement device with the traits described herein. Thus, the noise-abatement device can be made of one or more metals, metal alloys, composite materials, polymers, elastomers, ceramics, or any combination thereof. The various components of the noise-abatement device 200 can be made using any process. These processes can include, without limitation hydro-forming, stamping, punching, laser cutting, molding, or any other known method. For example, the elements of the noise-abatement device can be cut using any of the above processes. The desired features in the elements can then be formed, i.e., a port outlet 260 can be cut in the second end wall 255 or other desired location(s), a hole for the tool port 210 can be cut into the main body 245 of the housing 205, and the tool port 210 can be cut to length, formed, and fitted with any necessary adapter so it can be coupled to a pneumatic tool.

Once all the elements of the noise-abatement device 200 have been prepared, they can be joined together in their respective orientations. For example, the tool port 210 can be secured to the housing 205 at a desired location and be coupled to the housing 205, such as through an air-tight sealing method. Accordingly, the structure of one exemplary noise-abatement device 200 has been described, as well as exemplary methods of forming the noise-abatement device 200. As previously introduced, a stream of exhaust E, collectively referenced by arrows E, is directed from a pneumatic tool to the expansion chamber 240 through the tool port 210.

As the exhaust E is forced into the expansion chamber 240, the exhaust E can be reflected off the second end wall 255 and the non-perforated portion 275 of the tube. Such movement in turn causes the exhaust E to move toward the first end 215 of the housing 205 as the exhaust E expands. As the exhaust E moves toward the second end 220, at least a portion of the exhaust E is incident on the first end wall 250 as well as the main body 245, which causes exhaust E to be directed toward the tube 265 as the exhaust E continues to expand. As the exhaust E expands into the tube 265, the exhaust E passes into the tube 265 through the perforations 276 in the perforated section 270. Once the exhaust E has entered the tube 265, continuing expansion of the exhaust E causes it to reflect from the inner wall of the tube 265 as well as the first end wall 250 and to move toward the outlet 225 in the second end 285 of the tube 265. The exhaust E is then vented from the outlet 225 in the second end 285 of the tube 265 as shown.

Accordingly, as the exhaust E passes through the noise-abatement device 200, the exhaust can circulate, mix, and change the direction of the circulating flow, which can result in pressure and/or noise reduction, which can result in noise dissipation and thus overall noise reduction. The outlet 225 is positioned such that when the exhaust E contacts the end walls it can be reflected, which can also reduce the noise (reactive noise-abatement). The exhaust E finally vents through the outlet 225 to atmosphere. The mixing motion of the exhaust can reduce the directionality of the remaining noise and cause the noise to be effectively dispersed to atmosphere. As previously introduced, the expansion chamber can have any configuration and/or shape. Further, any number of tubes can be located within an expansion chamber.

Figure 3:
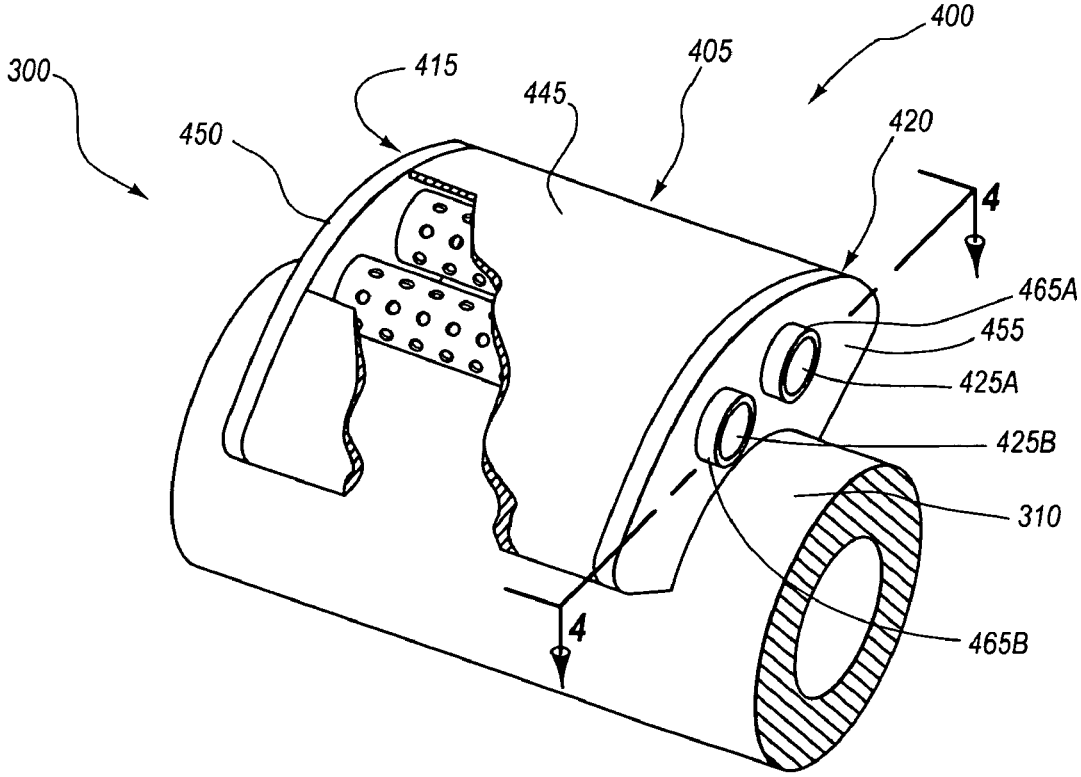
FIG. 3 illustrates a pneumatic tool having a noise-abatement device according to one example.

FIG. 3 illustrates a pneumatic tool 300 that includes a noise-abatement device 400 secured to a cylinder body 310. In the illustrated example, the pneumatic tool 300 is a pneumatic percussive drill. It will be appreciated that a noise-abatement device 400 can be used with other pneumatic tools, such as those previously introduced. In the illustrated example, the noise-abatement device 400 is directly secured to cylinder body 310. It will be appreciated that in other examples, the noise-abatement device 400 can be removably coupled to the cylinder body 310.

As illustrated in FIG. 3, the noise-abatement device 400 includes a housing 405 having a main body 445 between a first end 415 and a second end 420. Further, in the illustrated example, the housing 405 includes a main body 445 that extends between a first end wall 450 and a second end wall 455. In the illustrated example, the housing 405 is generally kidney-shaped. The housing 405 is also shown directly secured to the pneumatic tool 310. It will be appreciated that the housing 405 can also be coupled to the pneumatic tool 310 through intervening structures. Further, the main body 445 can be a substantially sealed unit. The main body 405 can be substantially enclosed independently of the pneumatic tool and/or edges of the main body 405 can be secured to the pneumatic tool 310 in such a manner that the portion of the cylinder body 310 to which the noise-abatement device 400 is secured forms an inner portion of the main body 405.

The noise-abatement device 400 includes a plurality of tubes 465A, 465B that extend through the second end wall 455. Exhaust from the pneumatic tool 310 that is directed to the housing 405 is in turn directed to the tubes 465A, 465B. Each of the tubes 465A, 465B includes outlets 425A, 425B that vent the tubes 465A, 465B to the atmosphere. Accordingly, exhaust from the pneumatic tool 310 is directed to the housing 405, into the tubes 465A, 465B and then to atmosphere. The housing 405 and tubes 465A, 465B are arranged and configured to slow the expansion and dissipation of the exhaust to thereby reduce the noise associated with venting the exhaust. The configuration of the interior of the noise-abatement device 400 will now be discussed in more detail.

Figure 4:
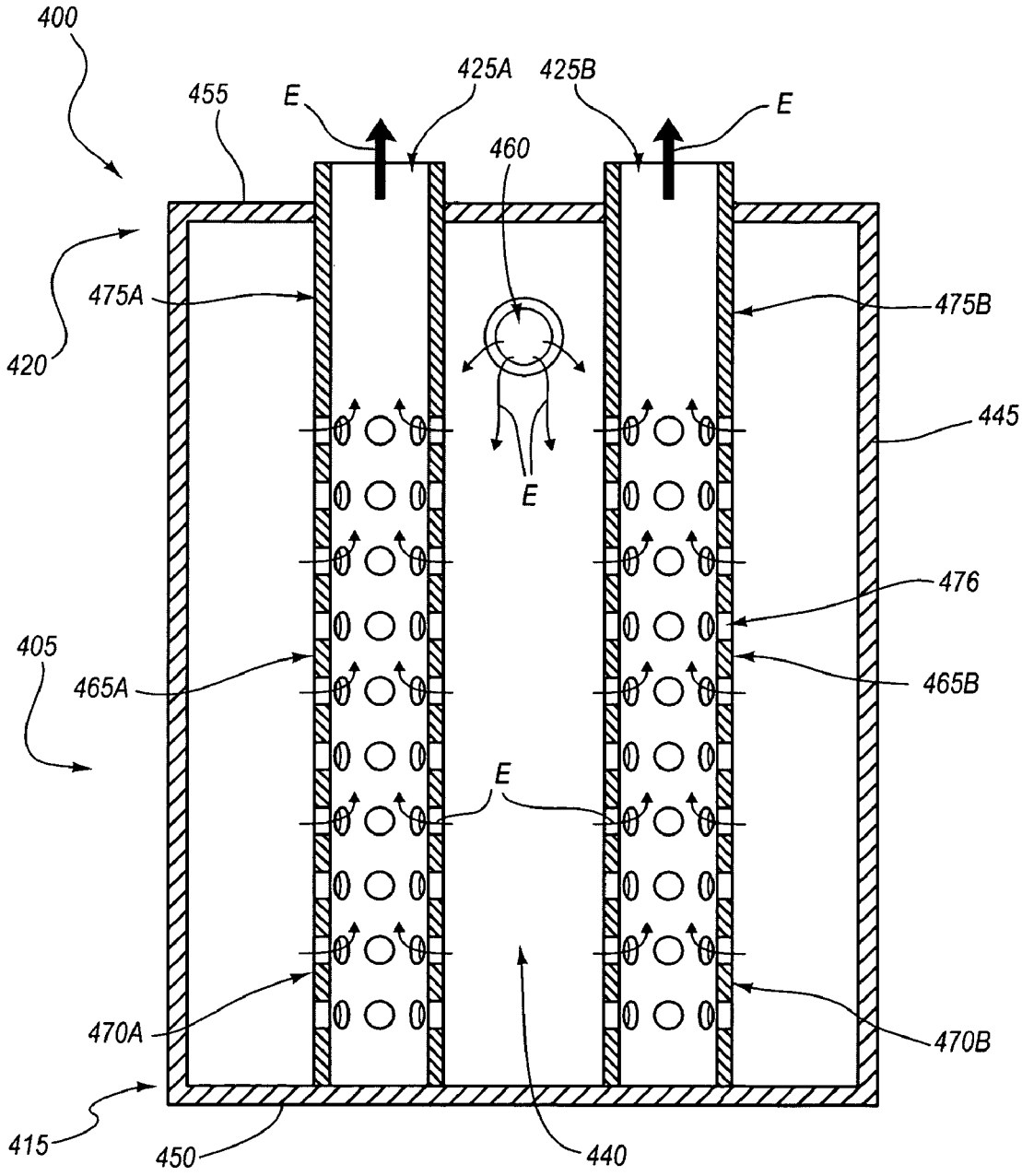
FIG. 4 illustrates a partial cross-sectional view of a noise-abatement device according to one example.

FIG. 4 is a partial cross-sectional view of the noise-abatement device 400 taken along section 4-4 in FIG. 3. As illustrated in FIG. 4, the housing 405 defines an expansion chamber 440. Exhaust E is directed into the expansion chamber 440 by way of outlet port 460. The outlet port 460 can be a direct port from the pneumatic tool 310 (FIG. 3) or can be an outlet defined in an inner portion of the main body 405.

Regardless of the configuration of the outlet port 460, the noise-abatement device 400 is positioned such that the outlet port 460 is toward the second end 415 of the housing 405. Further, in the illustrated example, the tubes 465A, 465B include perforated portions 470A, 470B and non-perforated portions 475A, 475B. In the illustrated example, at least part of at least one of the non-perforated portions 475A, 475B is positioned adjacent the outlet port 460 while at least part of at least one of the perforated portions 470A, 470B is positioned near the first end 415 of the housing 405.

The noise-abatement device 400 can be constructed of any material suitable for its purpose described herein. Therefore, the noise-abatement device can be made of metal alloys, composite materials, polymers, elastomers, or combinations thereof. The noise-abatement device 400 can be made using any process that will provide the structure described above. One example of a method for making the noise-abatement device 400 includes cutting out elements of the housing 405, including the main body 445 and first and second end walls 450, 455.

Next, the perforations 476 can be cut in the main body 445 to define the port outlet 460 as well as in the second end wall 455 to allow the tubes 465A, 465B to pass at least partially therethrough. Thereafter, the main body 405 can be shaped to the desired configuration. Each of the tubes 465A, 465B can be prepared as described above, by forming a tube through extrusion, rolling, other processes or combinations thereof after which perforations 476 can be formed therein. The above cutting processes can include hydro-forming, stamping, punching, laser cutting, other methods or combinations thereof The tubes 465A, 465B can then be secured to housing 405, such as by welding or otherwise securing the tubes 465A, 465B to the first and second end walls 450, 455.

The housing 405 can then be secured to the cylinder body 310 (FIG. 3), such as by welding, adhesives, fasteners, or combinations thereof While a process of directly securing the noise-abatement device 400 to the cylinder body 310 (FIG. 3) has been described, it will be appreciated that the housing 405 can be fluidly coupled to the cylinder body 310 (FIG. 3) in any suitable manner. To this point, the structure and formation of a noise-abatement device having multiple tubes with perforated portions has been described. The discussion will now turn to noise-abatement of exhaust E as it passes through the noise-abatement device 400.

As previously introduced, the outlet port 460 is in fluid communication with the pneumatic tool 300 (FIG. 3). Accordingly, the exhaust from the pneumatic tool 300 (FIG. 3) is forced from the pneumatic tool 300 to the expansion chamber 440. As the exhaust is forced into the expansion chamber 440, the exhaust E can be reflected off the second end wall 455 and at least one of the non-perforated portions 475A, 475B as the exhaust expands. Continued expansion in turn causes the exhaust E to expand into the first end 415 of the housing 405.

As the exhaust E moves toward the first end 415, at least a portion of the exhaust E is incident on the first end wall 450 as well as the main body 445, which causes exhaust E to expand into the tubes 465A, 465B. As the exhaust E expands into the tubes 465A, 465B, the exhaust E passes into the tubes 465A, 465B through the perforations 476 in the perforated sections 470A, 470B. Once the exhaust E has entered the tubes 465A, 465B; the reflection from the inner wall of the tube 465 as well as the first end wall 450 causes the exhaust E to expand toward the outlets 425A, 425B in the tubes 465A, 465B where the exhaust E is then vented as shown.

Accordingly, as the exhaust E passes through the noise-abatement device 400, the exhaust can circulate, mix, and change the direction of the circulating flow, which can result in pressure and/or noise reduction, which can result in noise dissipation and thus overall noise reduction.

The noise-abatement devices 200, 400 can be used to reduce the noise emitted from any pneumatic tool, such as a pneumatic percussive drill. In some instances, the emitted A-weighted sound pressure level (AwSPL) can be reduced by about 7 dB(A) to about 10 db(A) whereas other comparable devices reduce the emitted AwSPL by only about 4 dB(A) to about 7 db(A). Thus, the Noise-abatement device improves the noise reduction by about 3 dB(A), which equates to about a 50% reduction of noise.

In particular, the noise levels when drilling with a Boart Longyear S250M pneumatic percussive rock drill were measured. In this example, the drill was fitted first with a standard muffler and second with the noise-abatement device 400 as described above. The sound measurements were then recorded using a properly calibrated Svan 948 sound level meter which meets the requirements of IEC651, IEC804 and IEC61672-1 for Type 1 instruments. The Sound Pressure Levels (SPL's), ⅓ Octave and average (RMS) levels were recorded. The Svan 948 was placed 1 meter from the side of the S250M that was drilling into a Norrite block.

The average A-weighted SPL for the S250M fitted with a standard muffler was 114.8 dB(A). In contrast, the average A-weighted SPL for the S250M fitted with the device as described above was 111.3 dB(A), for a total average reduction of 3.5 dB(A). In this example, no measurable loss of drill performance (penetration rate) occurred.

Accordingly, the noise-abatement device can reduce noise better than can some conventional noise-abatement devices. The noise-abatement device can also be simpler in construction and compact in size. Additionally, as described above, the spinning motion can also reduce the directionality of noise that exits the outlet port, and thereby, cause the noise to disperse more effectively. Similarly, because the outlet port can be relatively large, the noise-abatement device can not impede the flow of exhaust so as to noticeably reduce the performance of the pneumatic tool. The noise-abatement device can be embodied in other specific forms without departing from the spirit or essential characteristics of this application. The described embodiments are to be considered in all respects only as illustrative and not restrictive. The scope of the application is, therefore, indicated by the appended claims rather than by the foregoing description. All changes that come within the meaning and range of equivalency of the claims are to be embraced within their scope.

What is claimed is:

1. A noise-abatement device for a pneumatic tool, comprising: a housing having a first end wall, a second end wall, and a body extending from the first end wall to the second end wall, the housing defining an expansion chamber therein;

at least one tube located at least partially within the expansion chamber, the tube having a first end, an opposing second end, a non-perforated portion proximate the second end, a perforated portion proximate the first end, and an outlet defined in the second end of the at least one tube, wherein the first end of the at least one tube is sealed thereby preventing fluid from entering or exiting the first end of the at least one tube, and wherein the perforated portion includes a first set of perforations a first distance from the first end wall and at least a second set of perforations a second distance from the first end wall, wherein the second distance differs from the first distance; and a port outlet in fluid communication with the expansion chamber, wherein the port outlet and the outlet are positioned closer to the second end wall of the housing than the first end wall.

2. The noise abatement device of claim 1, wherein the perforated portion of the tube is greater in length than the non-perforated portion.

3. The noise abatement device of claim 2, wherein the non-perforated portion of the tube extends from the second end wall toward the first end wall past the port outlet.

4. The noise-abatement device of claim 2, wherein the perforated portion of the tube is located near the first end wall of the housing relative to the port outlet and the outlet of the tube.

5. The noise-abatement device of claim 2, further comprising a plurality of tubes located at least partially within the expansion chamber, wherein at least one of the tubes vents through the second end wall of the housing.

6. The noise-abatement device of claim 5, wherein the port outlet and the outlet of at least one of the tubes are near closer to the second end wall of the housing than the first end wall of the housing and wherein the perforated portion of at least one of the tubes is located closer to the first end wall of the housing than the second end wall of the housing.

7. The noise-abatement device of claim 6, wherein the port outlet and the outlet of each of the tubes are adjacent the second end wall and the perforated portion of each of the tubes is located adjacent the first end wall of the housing relative to the port outlet.

8. The noise-abatement device of claim 7, wherein the first end of the tube is secured to the first end wall and the second end of the tube passes through the second end wall.

9. The noise-abatement device of claim 1, wherein the first end of the tube is secured to the first end wall and the second end of the tube is secured to the second end wall.

10. The noise-abatement device of claim 1, wherein the housing is generally cylindrical.

11. A noise-abatement device for a pneumatic tool, comprising:

a housing having a first end and a second end, the housing defining an expansion chamber therein;

at least one tube located at least partially within the expansion chamber, the tube having at least a perforated portion, a non-perforated portion, and an outlet defined therein, wherein the length of tube comprising the perforated portion is greater than the length of tube comprising the non-perforated portion, wherein the non-perforated portion is closer to the second end of the housing than the first end of the housing, wherein an end of the at least one tube adjacent the perforated portion and opposite the outlet is sealed by the first end of the housing thereby preventing fluid from entering or exiting the first end of the at least one tube; and a port outlet in fluid communication with the expansion chamber, wherein the port outlet is located adjacent at least part of the non-perforated portion.

12. The noise-abatement device of claim 11, wherein the port outlet and the outlet are located adjacent the second end of the housing.

13. The noise-abatement device of claim 12, wherein the non-perforated portion is located proximate the second end of the housing and wherein the perforated portion is located toward the first end of the housing.

14. The noise-abatement device of claim 13, wherein the tube extends through the second end of the housing.

15. The noise-abatement device of claim 11, further comprising a plurality of tubes located at least partially within the expansion chamber.

16. A pneumatic tool, comprising:

a cylinder body having a tool outlet defined therein;

a noise-abatement device fluidly coupled to the tool outlet, the noise-abatement device including a housing having a first end wall, a second end wall, and a body extending between the first end wall and the second end wall defining a expansion chamber having a longitudinal axis extending along the length thereof; and at least one tube located at least partially within the expansion chamber, the tube having a perforated portion, a non-perforated portion, and an outlet defined therein, wherein the length of the perforated portion is greater than the length of the non-perforated portion, and wherein the non-perforated portion extends from the second end wall, past the tool outlet, toward the first end wall;

wherein the tool outlet is oriented transverse to the longitudinal axis of the expansion chamber, and wherein exhaust from the tool outlet enters the expansion chamber adjacent the non-perforated portion of the tube.

17. The pneumatic tool of claim 16, wherein the housing is secured directly to the cylinder body and wherein tool outlet is in direct fluid communication with the expansion chamber.

18. The pneumatic tool of claim 16, wherein the noise-abatement device includes a port outlet in fluid communication with the expansion chamber, the port outlet being located adjacent the non-perforated portion of the tube.

19. The pneumatic tool of claim 16, wherein at least part of the perforated portion of the tube is located closer to the first end wall of the housing than an the second end wall of the housing, at least part of the non-perforated portion is located closer to the second end wall of the housing than the first end wall of the housing, and the outlet of the tube vents from the second end wall of the housing.

20. The pneumatic tool of claim 19, wherein the housing is generally cylindrically shaped.

21. The pneumatic tool of claim 16, further comprising a plurality of tubes located at least partially within the expansion chamber.

22. The pneumatic tool of claim 16, wherein the pneumatic cylinder body is a cylinder body of a pneumatic percussive drill.

23. The pneumatic tool of claim 16, wherein an end of the at least one tube adjacent the perforated portion and opposite the outlet is sealed thereby preventing fluid from entering or exiting the first end of the at least one tube.

24. The pneumatic tool of claim 16, wherein the perforated portion includes a first set of perforations a first distance from the first end wall and at least a second set of perforations a second distance from the first end wall, wherein the second distance differs from the first distance.

25. The pneumatic tool of claim 16, wherein the non--perforated portion of the at least one tube extends from the second end wall toward the first end wall past the tool outlet.

26. A pneumatic percussive drill, comprising:

a tool body having a port outlet defined therein;

a housing defining an expansion chamber extending between a first end wall of the housing and a second end wall of the housing, the housing being secured to the tool body; and a plurality of tubes located at least partially within the expansion chamber, the tubes each having a perforated portion, a non-perforated portion, and an outlet wherein the non-perforated portions are positioned adjacent second end wall and wherein at least one of the outlets vents to atmosphere through the housing, and wherein a first end of each tube of the plurality of tubes is sealed thereby preventing fluid from entering or exiting the first end of each tube of the plurality of tubes, and wherein the perforated portion of a first tube of the plurality of tubes includes a first set of perforations a first distance from the first end wall and at least a second set of perforations a second distance from the first end wall, wherein the second distance differs from the first distance.

27. The pneumatic percussive drill of claim 26, wherein the expansion chamber is in direct fluid communication with the port outlet.

28. The pneumatic percussive drill of claim 26, wherein at least one boundary of the expansion chamber is formed by the body.

29. The pneumatic percussive drill of claim 26, wherein the body is a pneumatic cylinder.

* * * * *

UNITED STATES PATENT AND TRADEMARK OFFICE

CERTIFICATE OF CORRECTION

PATENT NO. : 7,681,690 B2
APPLICATION NO. : 12/169514
DATED : March 23, 2010
INVENTOR(S) : Neil James Roberts and William Murray It is certified that error appears in the above-identified patent and that said Letters Patent is hereby corrected as shown below:

In Column 1, Line 57, delete "practiced" and insert -- practiced. --, therefor.

In Column 8, Line 44, delete "thereof" and insert -- thereof. --, therefor.

In Column 8, Line 49, delete "thereof" and insert -- thereof. --, therefor.

In Column 11, Line 42, in Claim 19, delete "an the" and insert -- the --, therefor.

In Column 12, Lines 16-17, in Claim 25, delete "non- -perforated" and insert -- non-perforated --, therefor.

In Column 12, Line 27, in Claim 26, delete "outlet" and insert -- outlet, --, therefor.

Signed and Sealed this

Twenty-seventh Day of April, 2010

David J. Kappos

David J. Kappos
*Director of the United States Patent and Trademark Office*